US009331424B2

(12) United States Patent
Yuan et al.

(10) Patent No.: US 9,331,424 B2
(45) Date of Patent: May 3, 2016

(54) ELECTRICAL CONNECTOR WITH A MATING PORT FOR DIFFERENT TRANSPORTING INTERFACES

(71) Applicant: HON HAI PRECISION INDUSTRY CO., LTD., New Taipei (TW)

(72) Inventors: Wei Yuan, Shenzhen (CN); Yu-San Hsiao, New Taipei (TW); Shih-Wei Hsiao, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 49 days.

(21) Appl. No.: 14/273,555

(22) Filed: May 9, 2014

(65) Prior Publication Data

US 2014/0335716 A1 Nov. 13, 2014

(30) Foreign Application Priority Data

May 9, 2013 (CN) ..... 2013 1 0168177

(51) Int. Cl.

| | |
|---|---|
| ***H01R 4/50*** | (2006.01) |
| ***H01R 13/62*** | (2006.01) |
| ***H01R 13/639*** | (2006.01) |
| ***H01R 27/02*** | (2006.01) |

(52) U.S. Cl.

CPC ..... *H01R 13/62* (2013.01); *H01R 13/639* (2013.01); *H01R 27/02* (2013.01)

(58) Field of Classification Search

CPC ..... H01R 13/6315; H01R 13/6275; H01R 13/6272; H01R 23/725; H01R 23/7073; H01R 13/65802; H01R 23/688; H01R 13/7197; H01R 23/6873

USPC ..... 439/74, 247, 248, 345, 352–358, 79, 439/607.01, 607.11, 607.12, 607.23

See application file for complete search history.

(56) References Cited

U.S. PATENT DOCUMENTS 3,544,951 A * 12/1970 Roberts ..... H01R 13/6275 403/329
4,544,225 A * 10/1985 Raus ..... H01R 13/639 439/296
5,151,049 A * 9/1992 Mosquera ..... H01R 12/675 439/353
5,364,287 A * 11/1994 Weber ..... H01R 13/6395 439/358
6,146,210 A * 11/2000 Cha ..... H01R 13/2421 439/289
6,171,131 B1 * 1/2001 Lee ..... H01R 13/6273 439/358
6,234,817 B1 * 5/2001 Hwang ..... H01R 13/6315 439/247
6,276,958 B1 * 8/2001 Chih ..... H01R 12/7047 439/357
6,315,590 B1 * 11/2001 Grois ..... G02B 6/389 439/248
6,406,192 B1 * 6/2002 Chen ..... H01R 13/6315 385/56
6,592,268 B2 * 7/2003 Chen ..... G02B 6/3879 385/56
6,695,650 B2 * 2/2004 Mueller ..... H01R 13/6315 439/247

* cited by examiner

*Primary Examiner* — Thanh Tam Le

(74) *Attorney, Agent, or Firm* — Wei Te Chung; Ming Chieh Chang

(57) ABSTRACT

An electric device assembly defines a first direction and a second direction perpendicular to each other. The electric device assembly includes a first electric device and a second device connecting each other. The first device includes a first electrical connector and a first securing element. The first connector defines a first mating port. The second device includes a second electrical connector defining a second mating port to be plugged and mated to the first mating port. The second device further includes a second securing element able to be separate from the second electrical connector. The second securing element is assembled to the second electrical connector and locked to the first securing element for electrically and mechanically connecting the first and second devices.

17 Claims, 6 Drawing Sheets

ELECTRICAL CONNECTOR WITH A MATING PORT FOR DIFFERENT TRANSPORTING INTERFACES

FIELD OF THE INVENTION

The present invention generally relates to an electric device assembly.

DESCRIPTION OF RELATED ART

An Electric devices, such as a television or a computer, are usually connected to another electric attachment (such as a voice box) for more functions. Ordinarily, the attachment is separated from the electric device. The power supply of the attachment is through a cable connected to an AC power source or the electric device. However, the arrangement of cables (including data-transmitting cables and power-transmitting cables) is complex. What's more, the transmitting quality of the data signal, especially in high-speed transmitting, would be lowered by surrounding electric elements.

In view of the foregoing, an electric device assembly with no cables and better transmitting quality would be desirable.

SUMMARY OF THE INVENTION

Accordingly, an object of the present invention is to provide an electric device assembly with a mating port with different transporting interfaces.

In order to achieve the object set forth, an electric device assembly defines a first direction and a second direction perpendicular to each other. The electric device assembly includes a first electric device and a second device connecting each other. The first device includes a first electrical connector and a first securing element. The first connector defines a first mating port. The second device includes a second electrical connector defining a second mating port to be plugged and mated to the first mating port. The second device further includes a second securing element able to be separate from the second electrical connector. The second securing element is assembled to the second electrical connector and locked to the first securing element for electrically and mechanically connecting the first and second devices.

Other objects, advantages and novel features of the invention will become more apparent from the following detailed description when taken in conjunction with the accompanying drawings.

DETAILED DESCRIPTION OF THE INVENTION

Figure 1:
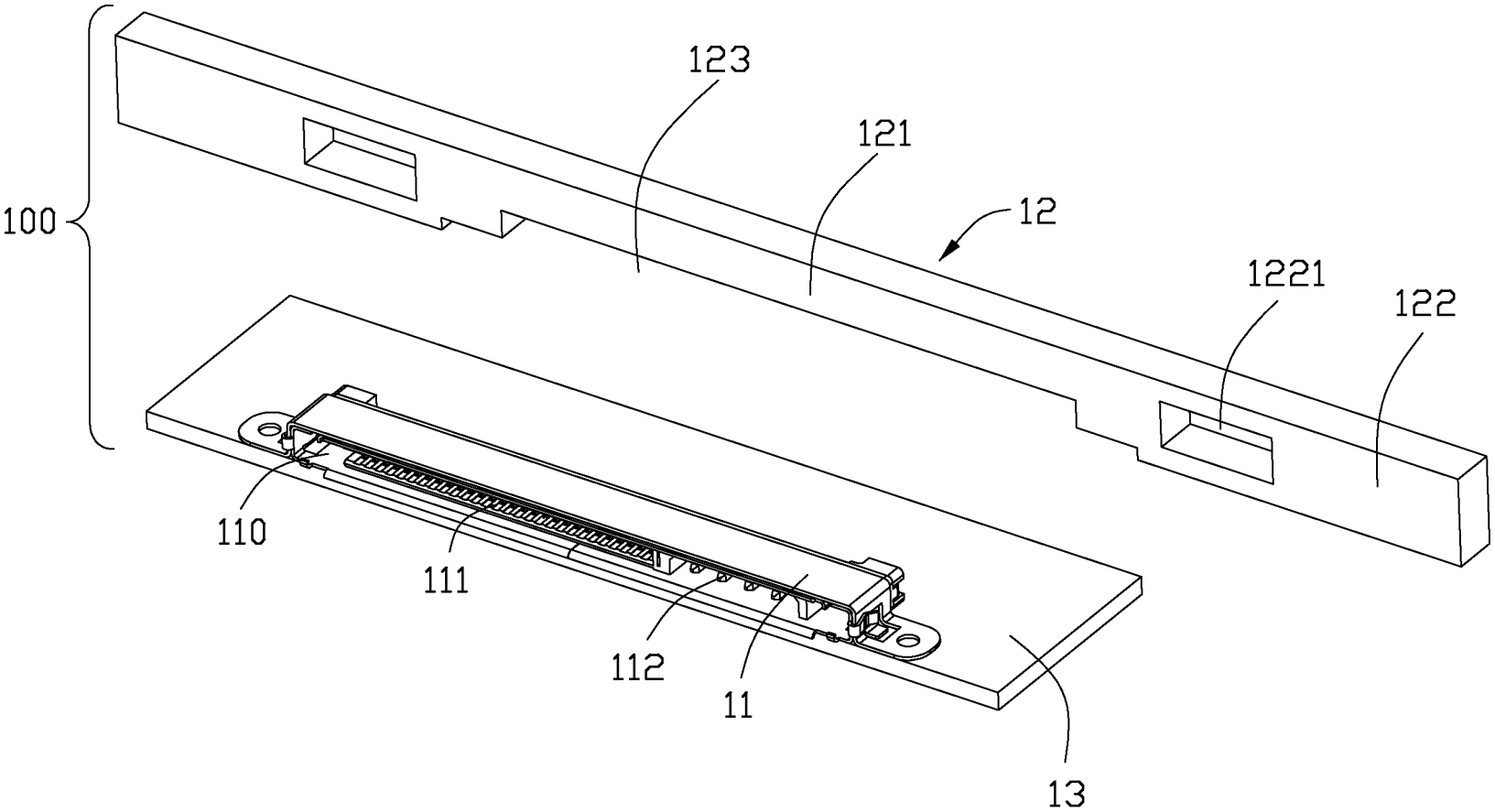
FIG. 1 is a perspective view of an electric device assembly of an embodiment in accordance with the present invention, wherein the first and second devices disconnect each other.
Figure 2:
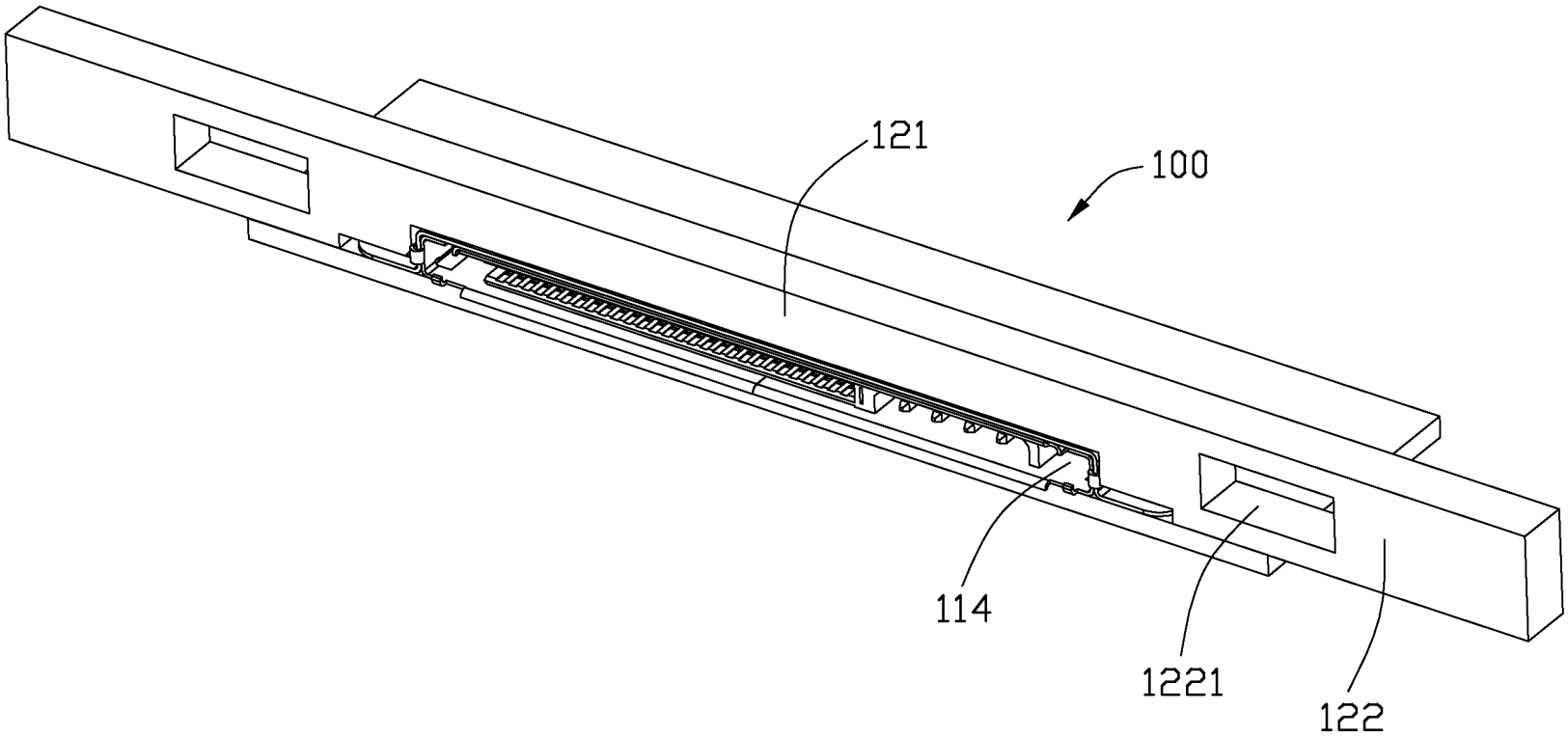
FIG. 2 is a perspective view of the first device and the first securing element shown in FIG. 1.

Reference will now be made in detail to the preferred embodiment of the present invention.

Referring to FIG. 1 to FIG. 6, an electric device assembly 1000 comprises a first device 100 and a second device 300 connecting to each other in a first direction. The first device 100 could be a video element, such as a television. And the second device 300 may be an attachment of the video device, such as a sound equipment or wireless device. The first device is only partially shown with a first electrical connector 11, a first securing element 12 and a first PCB (printed circuit board). The second device is shown with a second electrical connector 31, a second securing element 32 and a second PCB.

Referring to FIG. 1, the first securing element 12 could be molded only or together with the first electrical connector 11. The first securing element 12 extends in a lengthwise direction (defined as a second direction) and includes a pressing wall 121 and a pair of supporting blocks 122 extending from opposite sides of the pressing wall along a third direction perpendicular to both the first and second directions. The width of the pressing wall 121 in the third direction is less than the supporting blocks so as to form a receiving space 123 under the pressing wall. The first connector 11 is partially received in the receiving space 123. The pressing wall is just against to the top face of the electrical connector and the supporting blocks are against to the first PCB 13. The first connector 11 defines a mating space 110. A first data-signal transmitting interface 111 and a first power-signal transmitting interface 112 are formed in the mating space 110 to act as a first mating portion. The first electrical connector also includes a plurality of tails to solder and electrically connect to the first PCB 13.

Figure 3:
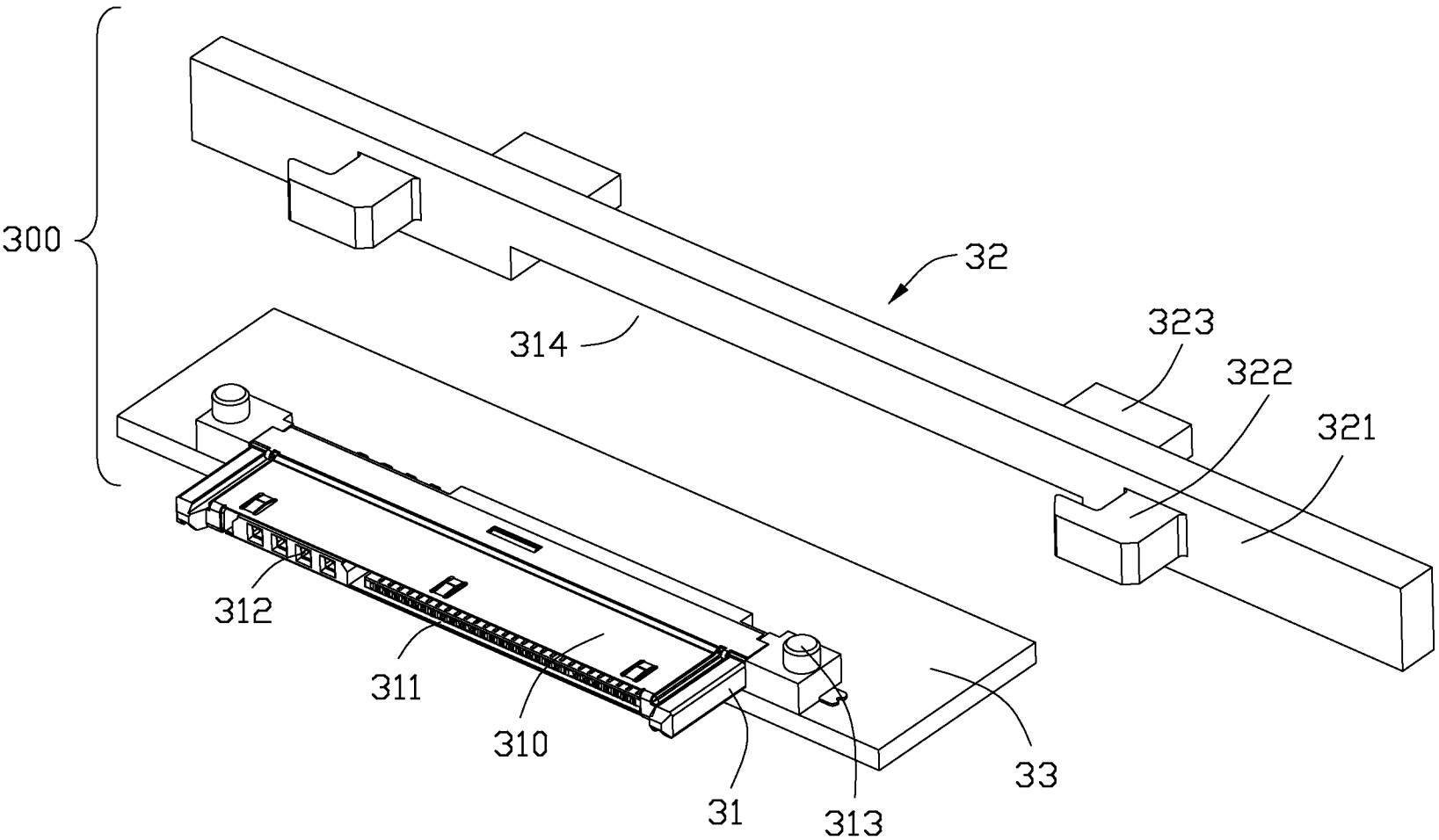
FIG. 3 is an exploded view of the first device and the first securing element shown in FIG. 2.
Figure 4:
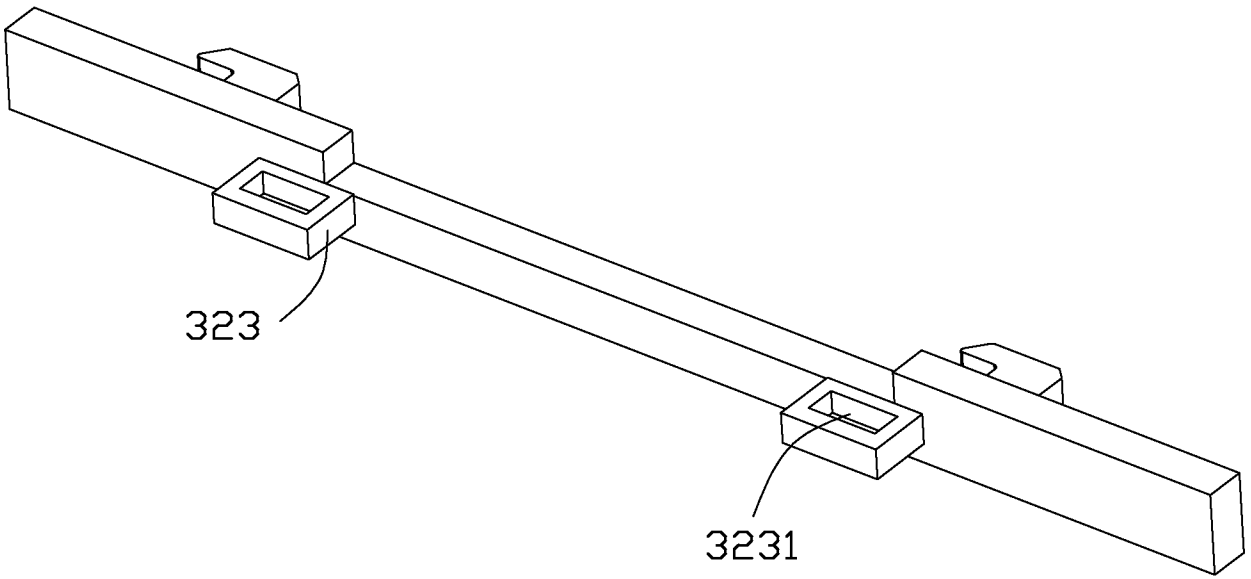
FIG. 4 is a perspective view of the first securing element shown in FIG. 3.

Combination with FIGS. 3 and 4, the second securing element 32 includes a base 321 parallel to the first securing element 12, two L-shaped locking portions 322 and a pair of mounting portions 323. The base 321 is in the same shape as the first securing element 12. The two L-shaped locking portions 322 extend towards the same side along the second direction. The base also defines a receiving space 314 for the second electrical connector 31. The supporting portion 122 of the first securing element 12 includes an opening 1221 to allow the L-shaped portions 322 to pass through and press against the back surface of the base 321.

The second electrical connector is soldered to the second PCB 33 on the back side. A mating port is defined as a second mating port 310 with a second data-signal transmitting interface 311 and a second power-signal transmitting interface 312 to mate with the first data-signal transmitting interface 111 and the first power-signal transmitting interface 112 respectively. With the electrical connection between transmitting interfaces, data signals and power signals are able to be transmitted between the first and the second electric devices. It is mentioned that the second electric device is provided with power through the power-signal transmitting interfaces, without any other power device.

Combining FIG. 3, the second electrical connector has a pair of retaining posts 313. The retaining posts 313 are located at backside and broadside of the second mating port so as to be not aligned with the second mating port in neither first direction nor the second direction. The second securing element 32 also includes two fixed portions 323 with slots 3231 extending along the second direction, the slots 3231 each passes through a bottom surface of the fixed portion 323 to receive a retaining post 313 therein and further to allow the retaining post 313 slide therein along the second direction.

Figure 5:
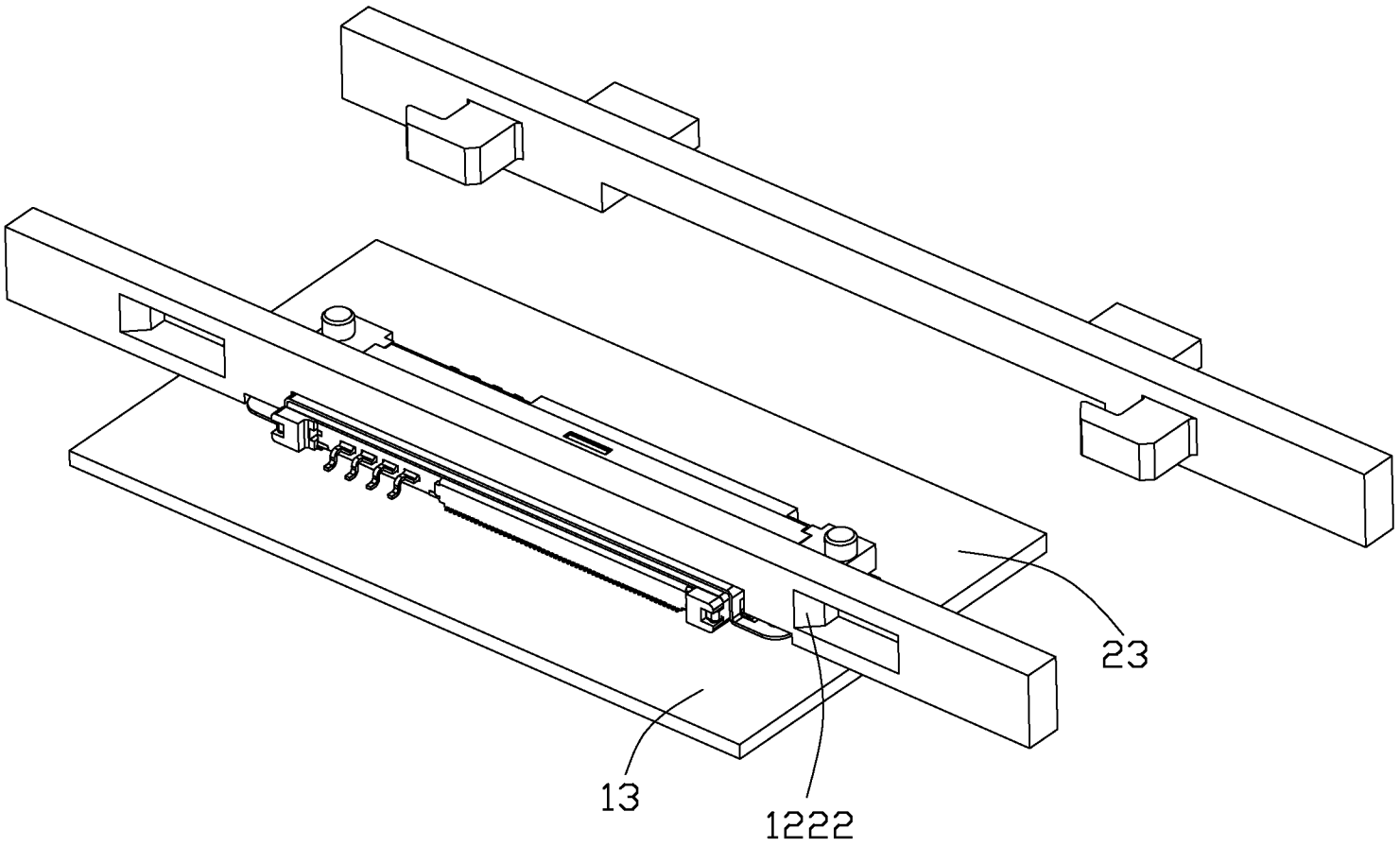
FIG. 5 is a partly exploded view of the electric device assembly shown in FIG. 1.
Figure 6:
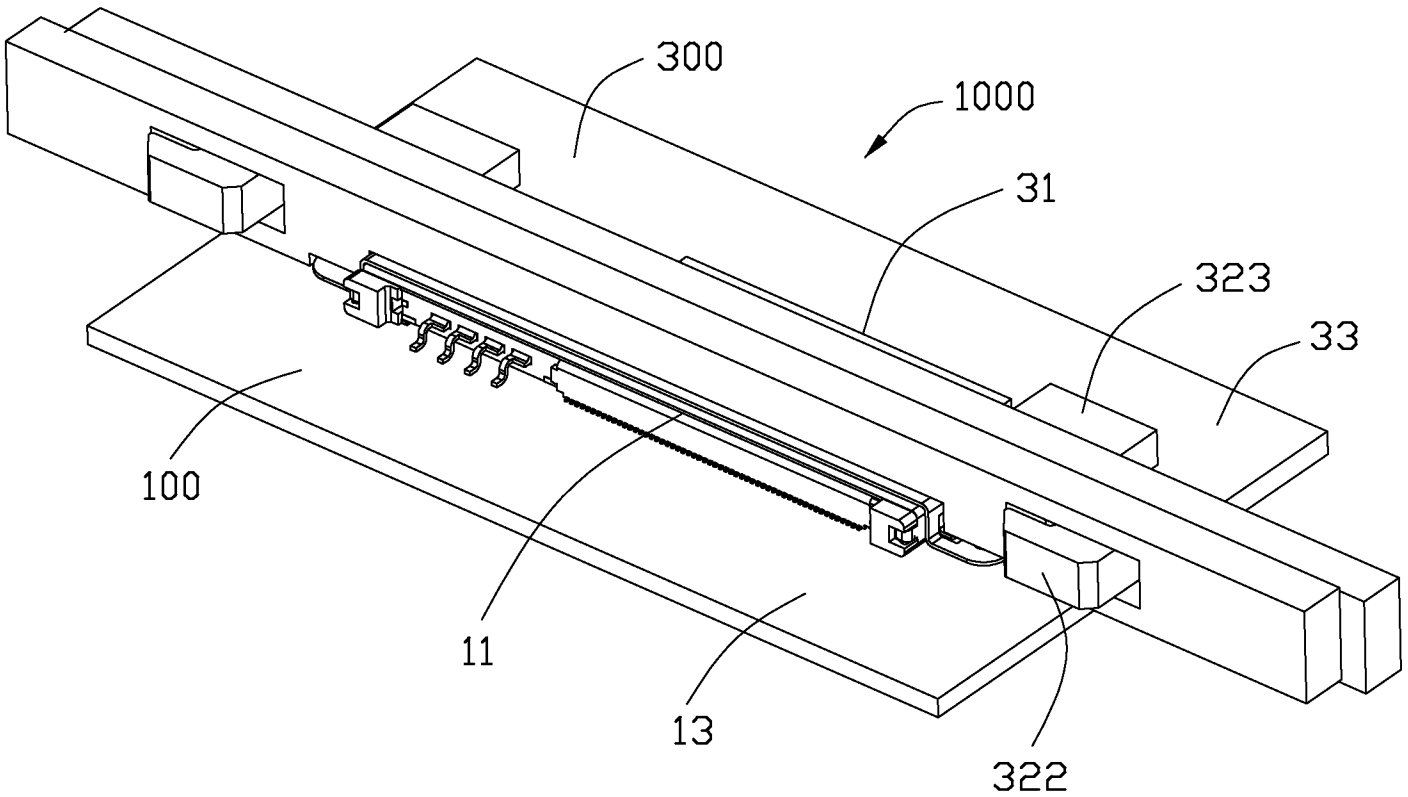
FIG. 6 is a perspective view of an electric device assembly, wherein the first and second devices connect each other.

Referring to FIGS. 5 and 6, at first, the second mating port 310 is plugged into the mating space 110 to achieve an electrically connection. And then assemble the second securing element 32 to the second connector 31 with the second securing element 32 abutting against the front face of the base 321 of the second element, the locking portions 322 running through corresponding openings 1221, and the retaining posts 313 received in the slots 3231. In the end, move the second securing element 32 along the second direction with the L-shaped locking portions 322 sliding in the openings 1221 and the retaining posts 313 sliding in the slots 3231. The movement would be stopped till the L-shaped locking portions 322 press against the back surface of the base of the first securing element 12. Through these assembling processes, the first electric device 100 and the second electric device 300 are able to both electrically and mechanically connect each other. The second electric device 300 (or the attachment) could extend functions of the first electric device 100. What's more, cables would be cancelled because of the direct connection between the first and second electric device, which can improve the electromagnetic interference around.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electric device assembly comprising:

a first device comprising a first electrical connector and a first securing element, the first connector defining a first mating port;

a second device adapted for mating the first device, comprising a second electrical connector defining a second mating port to be plugged and mated to the first mating port;

wherein the second device further comprises a second securing element separable from the second electrical connector; wherein the second securing element is assemble to the second electrical connector and locked to the first securing element for electrically and mechanically connecting the first and second devices; wherein the first and second electrical connectors are mated to each other along a first direction, one of the second connector and said second securing element defines at least one retaining post extending along a second direction perpendicular to said first direction, and the other of said second connector and said second securing element defines at least one slot for receiving said retaining post to allow said retaining post to slide therein along a third direction perpendicular to both said first direction and said second direction.

2. The electric device assembly as claimed in claim 1, wherein one of said first securing element and said second securing element defines at least one opening along the first direction, and the other of said first securing element and said second securing element defines at least a locking portion to pass through said opening and be locked thereto.

3. The electric device assembly as claimed in claim 2, said one of the first securing element and said second securing element defines two said openings spaced from each other in the third direction, and said other of the first securing element and said second securing element defines two said locking portions spaced from each other in the third direction.

4. The electric device assembly as claimed in claim 2, wherein the locking portion is L-shaped and extend towards one side in the third direction, the opening defines a guiding face each to guide the locking portion.

5. The electric device assembly as claimed in claim 1, wherein said retaining post is not aligned with the mating port neither in the first direction nor the third direction.

6. The electric device assembly as claimed in claim 4, wherein the second securing element defines a recess for receiving the second electrical connector, the L-shaped locking portion is located at one side of the recess.

7. The electric device assembly as claimed in claim 1, wherein a front face of the first securing element is aligned with a mating face of the first mating port.

8. The electric device assembly as claimed in claim 1, wherein each of the first and second electrical connectors comprises a power-transmitting interface and a data-transmitting interface, and the first device provides power for the second device through the power-transmitting interface.

9. An electrical assembly comprising:

a first device including an first electrical connector mounted upon a first printed circuit board and a first securing device fixed to at least one of said first electrical connector and said first printed circuit board around said first electrical connector;

a second device including a second electrical connector mounted upon a second printed circuit board and a second securing device detachably attached to the first securing device means for mounting the second securing device to the second electrical connector in a first direction wherein the electrical connector and the second electrical connector are not mated with each other, the first securing device and said second securing device are spaced from each other in a second direction perpendicular to said first direction, and the second securing device is allowed to move, in a sliding manner, relative to the second electrical connector not in the second direction but in a third direction perpendicular to both said first direction and said second direction;

means for having the first securing device and said second securing device in a temporary retention position when said first electrical connector and said second electrical connector are mated with each other along said second direction wherein the first electrical connector and said electrical connector is allowed to be unmated reversely along said second direction; and means for locking the first electrical connector and said second electrical connector together in an mated manner after making a relative movement between the first securing device and said second securing device in said third direction wherein the first electrical connector and said second electrical connector are not allowed to be unmated reversely along said second direction.

10. The electrical assembly as claimed in claim 9, wherein said first direction is a vertical direction, the second direction is a front-to-back direction and the third direction is a transverse direction.

11. The electrical assembly as claimed in claim 9, wherein said means for locking the first electrical connector and the second electrical connector includes a hook on the second securing device and an opening in the first securing device to receive said hook.

12. The electrical assembly as claimed in claim 11, wherein cooperation of said opening and said hook further restrict movement between the first securing device and the second securing device in the first direction.

13. The electrical assembly as claimed in claim 9, wherein said means for mounting the second securing device to the second electrical connector in a first direction includes a retaining post on the second electrical connector and a slot formed in the second securing device.

14. The electrical assembly as claimed in claim 9, wherein said first securing device forms a receiving space facing the first printed circuit board to accommodate the first electrical connector therein.

15. The electrical assembly as claimed in claim 9, wherein the second securing device forms a receiving space facing the second printed circuit board to accommodate the second electrical connector.

16. The electrical assembly as claimed in claim 9, wherein the first securing device includes an elongated base extending along the third direction, and the second securing device includes another elongated base extending along the third direction and intimately confronting the elongated base of the first securing device in the second direction when the first electrical connector and the second electrical connector are locked to each other.

17. The electrical assembly as claimed in claim 15, wherein means for mounting the second securing device to the second electrical connector in a first direction and means for locking the first electrical connector and said second electrical connector together in an mated manner are respectively located on two opposite sides of the corresponding elongated base in the second direction.

* * * * *